US008002590B2

(12) United States Patent
Ciezak et al.

(10) Patent No.: US 8,002,590 B2
(45) Date of Patent: Aug. 23, 2011

(54) ELECTRIC CONNECTOR AND METHOD OF PERFORMING ELECTRONIC CONNECTION

(75) Inventors: Andrew Ciezak, Mokena, IL (US); David A. Dylkiewicz, Lockport, IL (US); Michael V. Doorhy, Mokena, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 12/400,456

(22) Filed: Mar. 9, 2009

(65) Prior Publication Data

US 2009/0170377 A1 Jul. 2, 2009

Related U.S. Application Data

(63) Continuation of application No. 11/210,988, filed on Aug. 24, 2005, now Pat. No. 7,500,883, which is a continuation of application No. 10/721,523, filed on Nov. 25, 2003, now Pat. No. 7,052,328.

(60) Provisional application No. 60/429,343, filed on Nov. 27, 2002.

(51) Int. Cl.
*H01R 24/00* (2006.01)

(52) U.S. Cl. ..... 439/676

(58) Field of Classification Search ..... 439/676, 439/941

See application file for complete search history.

(56) References Cited

U.S. PATENT DOCUMENTS

| | | | | |
|---|---|---|---|---|
| 5,941,734 | A * | 8/1999 | Ikeda et al. | 439/676 |
| 6,045,390 | A * | 4/2000 | Metz et al. | 439/405 |
| 6,267,617 | B1 * | 7/2001 | Nozick | 439/417 |
| 6,305,950 | B1 * | 10/2001 | Doorhy | 439/76.1 |
| 6,488,525 | B2 * | 12/2002 | Abel et al. | 439/404 |
| 6,641,443 | B1 * | 11/2003 | Itano et al. | 439/676 |
| 6,729,914 | B2 * | 5/2004 | Jaouen | 439/676 |
| 6,739,898 | B1 * | 5/2004 | Ma et al. | 439/404 |
| 6,746,283 | B2 * | 6/2004 | Arnett et al. | 439/676 |
| 6,769,937 | B1 * | 8/2004 | Roberts | 439/676 |
| 6,786,775 | B1 * | 9/2004 | Hanrahan et al. | 439/676 |
| 6,786,776 | B2 * | 9/2004 | Itano et al. | 439/676 |
| 7,186,148 | B2 * | 3/2007 | Hashim | 439/676 |
| 7,500,883 | B2 * | 3/2009 | Ciezak et al. | 439/676 |
| 2002/0081908 | A1 * | 6/2002 | Ahn et al. | 439/676 |
| 2003/0119372 | A1 * | 6/2003 | Aekins | 439/676 |
| 2004/0002267 | A1 * | 1/2004 | Hatterscheid et al. | 439/676 |
| 2004/0082227 | A1 * | 4/2004 | Hashim | 439/676 |
| 2004/0127105 | A1 * | 7/2004 | Itano et al. | 439/676 |
| 2006/0121790 | A1 * | 6/2006 | Hashim | 439/676 |

* cited by examiner

*Primary Examiner* — Ross N Gushi

(74) *Attorney, Agent, or Firm* — Robert A. McCann; Christopher S. Clancy; Christopher K. Marlow

(57) ABSTRACT

A modular jack assembly having a housing and a plug interface contact (PIC) sled subassembly insertable into the housing. The PIC sled subassembly provides an electrical and mechanical interface between PICs and a male-type plug receivable in an opening in the housing. The PIC sled subassembly is defined in part by multiple slots formed in the PIC sled subassembly that receive the PICs. The design of the PICs compensates for independent near-end cross-talk vectors and far-end cross-talk vectors to obtain a desired level of electrical characteristics.

5 Claims, 9 Drawing Sheets

ELECTRIC CONNECTOR AND METHOD OF PERFORMING ELECTRONIC CONNECTION

RELATED APPLICATIONS

This application is a continuation of U.S. patent application Ser. No. 11/210,988, filed Aug. 24, 2005, now U.S. Pat. No. 7,500,883, which is a continuation of U.S. patent application Ser. No. 10/721,523, filed Nov. 25, 2003, now U.S. Pat. No. 7,052,328, which claims priority to U.S. Provisional Patent Application No. 60/429,343, filed Nov. 27, 2002.

BACKGROUND OF THE INVENTION

1. Field of Invention

The invention relates to electronic connectors and methods for performing electronic connection. More particularly, the invention relates to a modular jack assembly that can be connected to an electrical cable and can be used in connection with any type of electronic equipment, such as communication equipment, for example.

2. Description of Related Art

Electronic connectors are used to connect many types of electronic equipment, such as communications equipment. Some communications connectors utilize modular designs, which are hereinafter referred to as "modular jack assemblies".

Telephone jack assemblies constitute one example of such modular jack assemblies. Some of these jack assemblies may be required to handle increasing signal transmission rates of various communication equipment.

SUMMARY OF THE INVENTION

It may be beneficial for a modular jack assembly to exhibit various characteristics.

For example, a modular jack assembly may facilitate the obtainment of a desired level of electrical characteristics, such as near-end cross-talk (NEXT), far-end cross-talk (FEXT), return loss (RL) and insertion loss (IL), to adhere to or substantially adhere to past, present and/or future specifications and/or requirements. It may also be beneficial to provide a modular jack assembly that facilitates enhanced and consistent cross-talk performance.

An electrical cable, such as a cable containing four twisted pairs of wires, for example, can be connected to a modular jack assembly. If the twisted pairs are untwisted or distorted in a non-consistent manner when this connection is made, the electrical characteristics of the combination of the cable and the connector will be inconsistent and the electrical signals transmitted through them will be degraded.

For example, plug interface contacts (PICs) of any modular jack assembly need to mate, both mechanically and electromagnetically, with a set of contacts from a modular plug. The design of the PICs, for example, as part of the modular jack assembly needs to compensate for independent NEXT vectors and/or FEXT vectors with frequency dependant magnitudes, (measured in decibels (dB)) and frequency dependant phases (measured in degrees).

Matching the magnitude and phase of such vectors that exist in a modular plug may often be a factor in the design and/or usage of a modular jack assembly. It may therefore be beneficial to design a modular jack assembly that compensates for NEXT and/or FEXT vectors of a plurality of twisted pairs of wire combinations. For example, it may also be beneficial to design a modular jack assembly that compensates for NEXT and/or FEXT vectors across an electrical cable having four or six twisted pairs of wire combinations.

PIC lengths may add a time delay to a signal passing along the contacts. The time delay factor makes compensating for the magnitude and phase of the plug NEXT and/or FEXT vector difficult at higher frequencies. Accordingly, it may therefore be beneficial to provide a modular jack assembly that matches the magnitude and phase of such vectors within the shortest allowable length for each of the PICs.

The physical design of the jack PICs used in a modular jack assembly can be used to change the NEXT and/or FEXT vector performance by changing the inductive and/or capacitive coupling in the PICs. Thus, it may be beneficial to provide a modular jack assembly that takes into consideration the capacitive imbalance and/or inductive imbalance when minimizing cross-talk interaction.

A modular jack assembly may use a printed circuit board to mechanically and electrically mate the PICs and insulation displacement contacts (IDC) of a modular jack assembly. Accordingly, it may be beneficial to provide the printed circuit board to strategically add additional capacitive coupling to maximize component and channel performance.

For example, the physical design of the printed circuit board may be made to reduce or minimize the NEXT and/or FEXT within the printed circuit board. Therefore, it may be beneficial to provide a printed circuit that minimizes or reduces the NEXT and/or FEXT by taking into consideration the capacitive imbalances and inductive imbalances present.

A modular jack assembly may use IDCs to mechanically and electrically mate the modular jack to an electrical cable or a transmission line conductor. Thus, it may be beneficial to configure the IDCs in an orientation so as to minimize or reduce the cross-talk that is introduced by the IDCs.

Size and spacing requirements may often be a factor in the design and/or usage of a modular jack assembly. It may therefore be beneficial to provide a modular jack assembly that is relatively compact and/or small in size.

The general utility of a modular jack assembly may also be a factor to be considered. For example, it may be beneficial to provide a modular jack assembly that is relatively easy to connect to cable and/or other electronic equipment, and/or that can be quickly connected to such cable and/or other electronic equipment. For example, it may be beneficial to provide a modular jack assembly that facilitates simple field installation.

Production costs may be a factor to be considered for a modular jack assembly. Thus, it may be beneficial to provide a modular jack assembly that can be quickly, easily and/or economically manufactured.

The invention provides a modular jack assembly, for example, that addresses and/or achieves at least one of the above characteristics and/or other characteristics not specifically or generally discussed above. Thus, the invention is not limited to addressing and/or achieving any of the above characteristics.

An exemplary modular jack assembly of the invention includes plug interface contacts, a printed circuit board and insulation displacement contacts that optimize performance of the modular jack assembly.

Another exemplary modular jack assembly of the invention includes plug interface contacts that mate with a set of contacts from a modular plug both electrically and mechanically. In one exemplary embodiment, the PICs have the shortest allowable length while matching the magnitude and phase of the plug NEXT and/or FEXT vector.

Another exemplary modular jack assembly of the invention includes the printed circuit board that mechanically and electrically mate the PICs and the IDCs. In one exemplary embodiment, the printed circuit board may also be used to strategically add additional capacitive coupling to maximize the component and channel performance of the modular jack assembly.

Another exemplary modular jack assembly of the invention includes IDCs used to mechanically and electrically mate the modular jack assembly to electrical cable or transmission line conductors. In one exemplary embodiment, the IDCs are of the shortest allowable length without introducing additional NEXT and/or FEXT.

An exemplary modular jack assembly of the invention includes a wire containment cap that is connectable to wires of a cable that includes a cable jack external multiple twisted pairs of wires and receives a rear sled. The rear sled may be a molded thermoplastic component designed to accommodate and restrain the insulation displacement contacts.

In another exemplary embodiment of the invention, the modular jack assembly includes a PIC sled assembly to position the PICs for insertion into the printed circuit board and provide proper alignment to mate with a set of contacts from the modular plug both mechanically and electromagnetically.

In another exemplary embodiment of the invention, the rear sled mates to a housing by a stirrup-type snaps and a cantilever snap. The housing is of a shape to receive a modular plug.

In another exemplary embodiment of the invention, the rear sled mates to a housing by a hoop-type snap and a cantilever snap. The housing is of a shape to receive a modular plug.

These and other features and advantages of this invention is described in or are apparent from the following detail description of various exemplary embodiments of the systems and methods according to the invention.

BRIEF DESCRIPTION OF THE DRAWINGS

In various exemplary embodiment of the systems and methods according to this invention will be described in detail, with reference to the following figures, wherein.

DETAILED DESCRIPTION OF PREFERRED EMBODIMENTS

Various exemplary embodiments of the invention are described below with reference to the figures. The exemplary embodiments described below are merely provided for illustrative purposes, and are not intended to limit the scope of protection for the invention.

Figure 1:
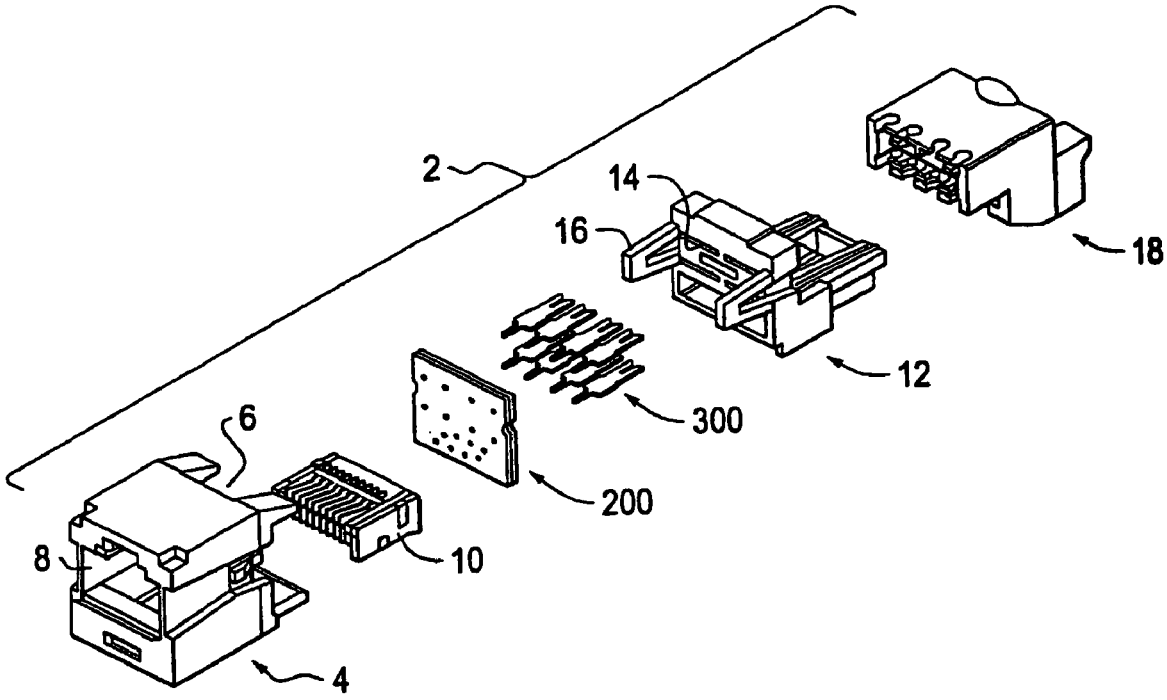
FIG. 1 is an exploded perspective view of a modular jack assembly in accordance with an exemplary embodiment of the invention.

FIG. 1 is an exploded perspective view of a modular jack assembly in accordance with an exemplary embodiment of the invention.

As shown in FIG. 1, the modular jack assembly 2 includes a housing 4. The housing 4 is substantially hollow and defines a housing opening 6 at its rear end. A female-type receptacle 8 is defined at the front end of the housing 4. A PIC sled subassembly 10 is insertable into the housing opening 6. The PIC sled subassembly 10 provides an electrical and mechanical interface between PICs 100 (FIG. 2) and a male-type plug (not shown) receivable in the female-type receptacle 8. The PIC sled subassembly 10 is defined in part by multiple slots formed in the PIC sled subassembly 10 that receive the PICs 100. However, the invention is intended to cover any method of holding the PICs 100 in place. For example, the PICs 100 can be clamped to the PIC sled subassembly 10.

However, the invention is also intended to cover any type of electrical connection device other than the female-type receptacle 8 shown in FIG. 1. For example, the female-type receptacle 8 can be replaced with a male plug, or any other currently known or later developed type of electrical connection device, to receive a female-type plug.

Further, the housing 4 and the PIC sled subassembly 10 can be manufactured of any material or materials. In one exemplary embodiment, the PIC sled subassembly 10 is synthetic resin which enables the slots of the PIC sled subassembly 10 to be substantially insulated from each other. Similarly, the housing 4 and the PIC sled subassembly 10 can be manufactured by any currently known or later developed method, such as by molding, for example.

The PICs 100 (FIG. 2) are insertable into the PIC sled subassembly 10 to provide contact points for a male plug (not shown) when inserted into the female-type receptacle 8. The PICs 100 further contact a printed circuit board 200 to mechanically and electrically mate the PICs 100 and insulation displacement contacts (IDCs) 300. The printed circuit board 200 is also used to strategically add additional capacitive and/or capacitive coupling to maximize the component and channel performance of the modular jack assembly 2.

The compliant pins 302 (FIG. 8) of the IDCs 300 are insertable into the printed circuit board 200. A rear end 305 of the IDCs 300 are insertable into a rear sled 12. The rear sled 12 includes a plurality of IDC containment slots 14 to receive the IDCs 300. The rear sled 12 mates to the housing 4 by two stirrup-type snaps 16 and one cantilever snap (not shown). When the rear sled 12 is mated to the housing 4 the PIC sled subassembly 10, PICs 100, printed circuit board 200 and IDCs 300, are held securely in place to form the modular jack assembly 2.

Figure 12:
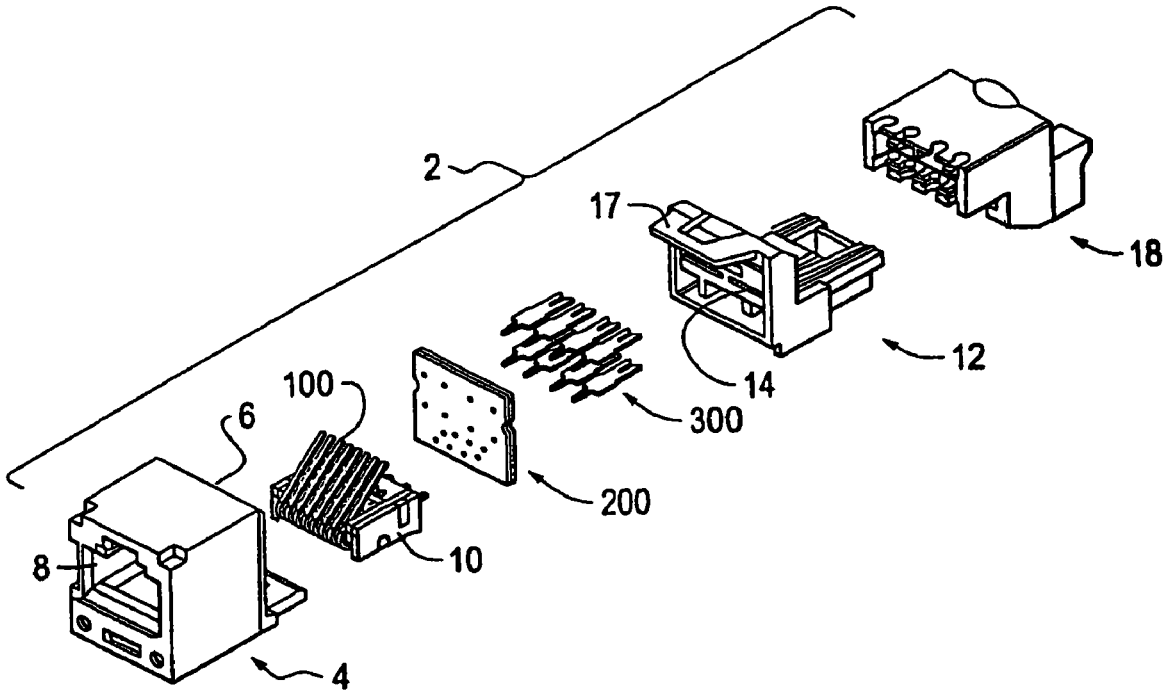
FIG. 12 is an exploded perspective view of a modular jack assembly having plug interface contacts installed in the front sled, and a hoop-type snap on the rear sled, in accordance with an exemplary embodiment of the invention.

Although the above exemplary embodiment is described having the rear sled 12 mated to the housing 4 by two stirrup-type snaps 16 and one cantilever snap (not shown), other snaps may be used to mate the rear sled 12 to the housing 4. For example, as shown in FIG. 12, the rear sled 12 mated to the housing 4 by a hoop-type snap 17 and one cantilever snap (not shown).

A wire containment cap 18 is attachable to a rear side of the rear sled 12. The wire containment cap 18 is connectable to wires of an electrical cable or transmission line that includes a cable jacket surrounding multiple twisted pairs of wires. The wire containment cap 18 is hollow and defines a channel therein, such that the cable is insertable into a rear end opening of the channel. The wire containment cap 18 may include a structure, such as a stepped portion, for example, to prevent the cable jacket from extending into the channel beyond a certain distance from the rear end opening. This feature would enable the twisted pairs of wires to extend beyond the cable jacket through a substantial portion of the channel in a manner which enhances electrical characteristics.

The rear sled 12 and the wire containment cap 18 can be manufactured of any material or materials. In one exemplary embodiment, the rear sled 12 and the wire containment cap 18 are synthetic resin which enables the rear sled 12 and the wire containment cap 18 to be substantially insulated from each other. Similarly, the rear sled 12 and the wire containment cap 18 can be manufactured by any currently known or later developed method, such as by molding, for example.

Figure 2:
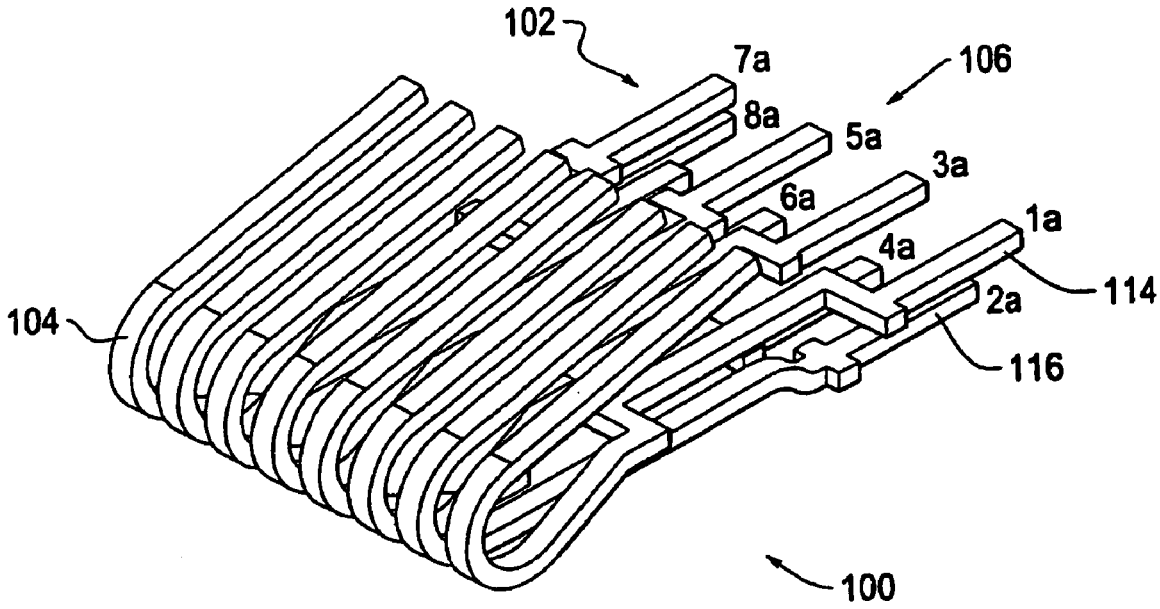
FIG. 2 is a perspective view of an exemplary embodiment of the plug interface contacts according to the invention.

FIG. 2 is a perspective view of an exemplary embodiment of the PICs according to the invention.

As shown in FIG. 2, the PICs 100 include a plurality of integrally formed compliant pins 102 and rows of contact points 114, 116. The PICs 100 mate with a set of contacts from a modular plug at a front portion 104 of the PICs when such a plug is inserted into the female-type receptacle 8 of the housing 4. Each of the integrally formed compliant pins 102 are insertable into the PIC sled subassembly 10 to contact the male-type plug. The PICs 100 contact the printed circuit board 200 at a rear portion 106. The compliant pins 102 provide a conductor to electrically and mechanically mate a modular plug to the printed circuit board 200.

In an exemplary embodiment shown in FIG. 2, the PICs 100 include 8 compliant pins 102. In the embodiment, a top row 114 of PICs 100 are numbered as pins 1*a*, 3*a*, 5*a* and 7*a*, and a bottom row 116 of PICs 100 are numbered as pins 2*a*, 4*a*, 6*a* and 8*a*, respectively, for reference purposes. The pins 1*a*-8*a* contact the printed circuit board 200 at predetermined positions to correspond to pairs of wires connectable to the modular jack assembly 2 discussed below.

In the exemplary embodiment shown in FIG. 2, the PICs 100 define eight integrally formed PICs 100, which would correspond to four pairs of wires connectable to the modular jack assembly 2. However, the invention is not limited to this structure and is intended to cover any number (including just one) of rows of PICs 100. For example, the PICs 100 can include any number of PICs 100, arranged in one or a plurality of rows.

Figure 3:
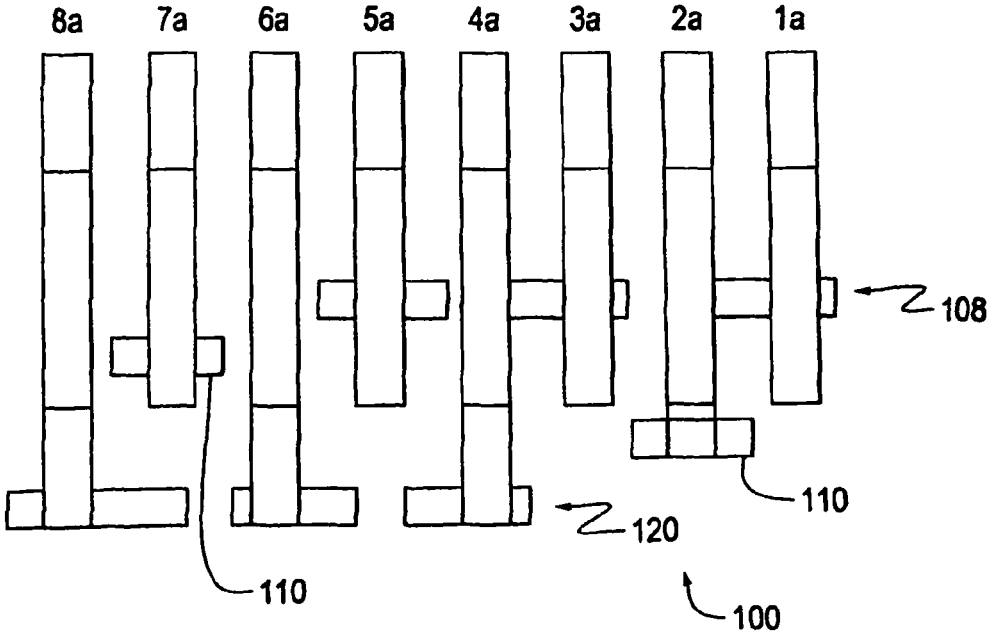
FIG. 3 is a front view of an exemplary embodiment of the plug interface contacts according to the invention.
Figure 4:
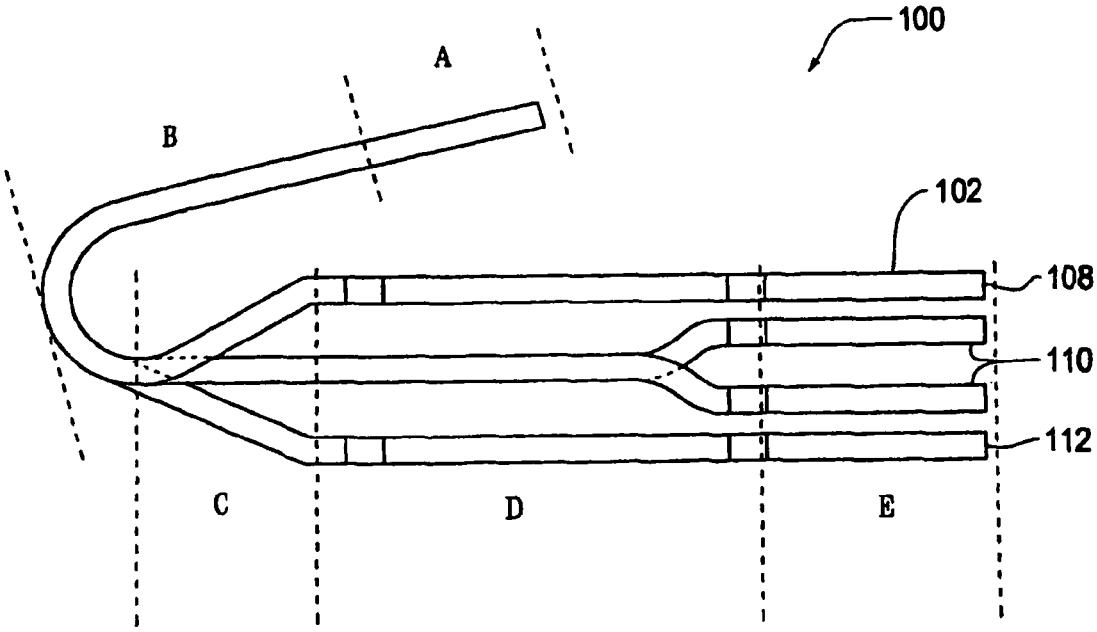
FIG. 4 is a side view of the plug interface contacts according to an exemplary embodiment of the invention.
Figure 5:
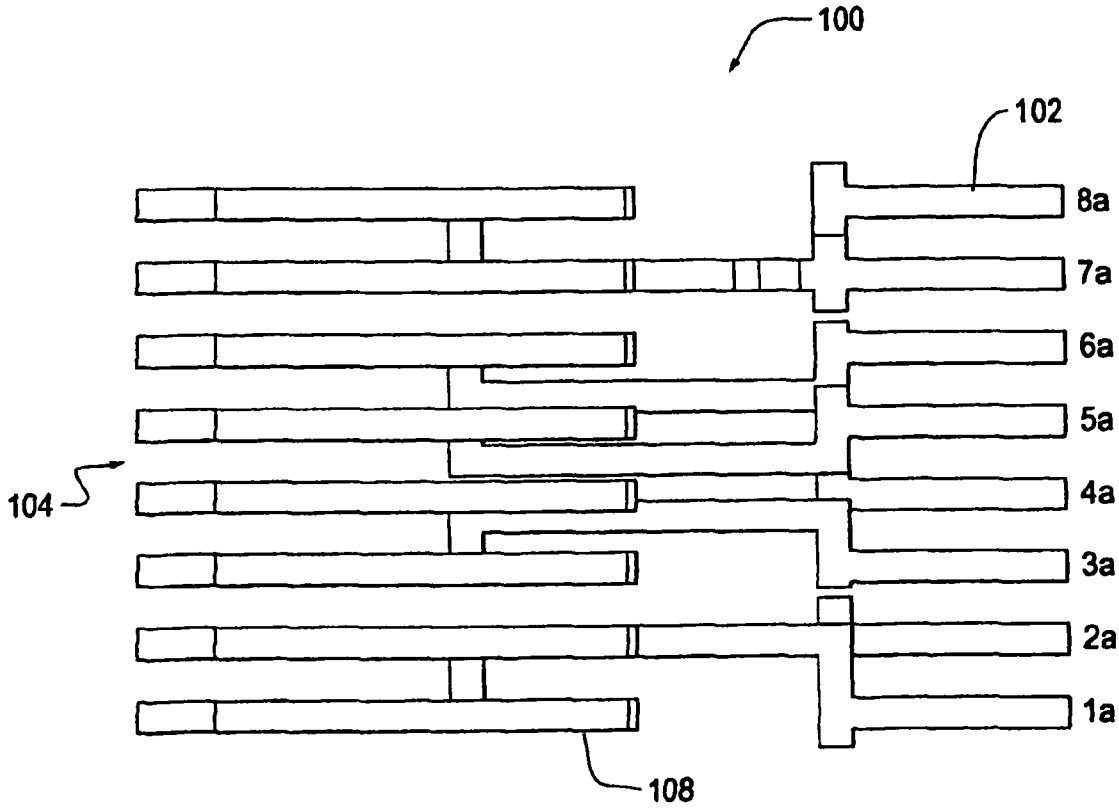
FIG. 5 is a top view of the plug interface contacts according to an exemplary embodiment of the invention.

FIG. 3 is a front view of an exemplary embodiment of the PICs 100 according to the invention. FIG. 4 is a side view of the plug interface contacts according to an exemplary embodiment of the invention. FIG. 5 is a top view of the plug interface contacts according to an exemplary embodiment of the invention.

As shown in FIGS. 3, 4 and 5, the physical design of the PICs is used to change NEXT and/or FEXT vectors by changing the inductive and/or capacitive coupling. In an exemplary embodiment, the PICs 100 are formed to create three compensation layers, including a top compensation layer 108, a middle compensation layer 110 and a bottom compensation layer 112. The three compensation layers 108, 110, 112 provide better symmetry between pair combinations to minimize potential differences in performance of different pairs. Additionally, the physical design of the PICs 100 provides for shorter plug interface lengths and shorter total electrical lengths to minimize undesired capacitive and/or inductive imbalances.

In an exemplary embodiment, as shown in FIG. 4, compensation layer sections C, D and E may be altered to compensate for capacitive and/or inductive imbalances between pair combinations by changing the length of the compensation sections C, D and E. Capacitive and\or inductive imbalances may also be compensated for by changing the distances between the compensation layers 108, 110, 112, as well as by changing the separation between sections C, D and E, as shown in FIG. 4. For example, as shown in FIG. 4, the length of the compensation section D may be altered. Further, the change in distance between the compensation layers 108, 110, 112 in sections D and E may also be changed, as may the separation between the compensation sections C, D and E.

In the exemplary embodiment, capacitive and\or inductive imbalances are compensated for by changing the distance between the compensation layers 108, 110, 112, as well as by changing the separation between sections C, D and E. However, the invention is not limited to this structure and is intended to cover any variations in the distance between any of the compensation layers 108, 110, 112, as well as the separation of any of the sections C, D, E among any of the compensation layers 108, 110, 112.

In an exemplary embodiment, the following pair combinations have capacitive (Cu) and inductive (Lu) interactions as provided in Table 1 below:

TABLE 1

| | |
|---|---|
| Cu 45, 36 = C46 + C35 − C34 − C56 | Lu 45, 36 = L46 + L35 − L34 − L56 |
| Cu 45, 12 = C41 + C52 − C51 − C42 | Lu 45, 12 = L41 + L52 − L51 − L42 |
| Cu 45, 78 = C47 + C58 − C57 − C48 | Lu 45, 78 = L47 + L58 − L57 − L48 |
| Cu 36, 12 = C31 + C62 − C61 − C32 | Lu 36, 12 = L31 + L62 − L61 − L32 |
| Cu 36, 78 = C37 + C68 − C67 − C38 | Lu 36, 78 = L37 + L68 − L67 − L38 |
| Cu 12, 78 = C17 + C28 − C27 − C18 | Lu 12, 78 = L17 + L28 − L27 − L18 |

The pair interactions referenced in Table 1 further combine to result in NEXT and/or FEXT values for each exemplary pair combination using the following equations:

$$\text{NEXT}=\text{Cross-talk from Cu}+\text{Cross-talk from Lu} \quad 1)$$

$$\text{FEXT}=\text{Cross-talk from Cu}-\text{Cross-talk from Lu.} \quad 2)$$

As shown in FIG. 4, cross-talk interactions in compensation layer section A include capacitive imbalance only within each pair combination as there is no current flow through section A of the PICs 100. In compensation layer sections B, C, D and E the cross-talk vectors include capacitive and/or inductive imbalance within each pair combination.

The NEXT and/or FEXT values calculated with each exemplary pair combination may be adjusted in sections A, C, D and E such that the contact pair combination vectors are at an optimum magnitude and phase to compensate for the plug vector.

In an exemplary embodiment of the invention, the design of the PICs 100 provides NEXT and/or FEXT magnitude and phase performance that allows the printed circuit board 200 to provide additional overall modular jack assembly performance above known standards for electrical connectors and/or communications equipment. For example, in an exemplary embodiment of the invention, NEXT and/or FEXT magnitude and phase performance may be provided in Table 2 below.

TABLE 2

| | NEXT | | FEXT | |
|---|---|---|---|---|
| | Magnitude | Phase | Magnitude | Phase |
| Pair 45, 36 | 49 dB | +90 deg. | 49 dB | −90 deg. |
| Pair 45, 12 | 60 dB | +90 deg. | 60 dB | −90 deg. |
| Pair 45, 78 | 60 dB | +90 deg. | 60 dB | −90 deg. |
| Pair 36 12 | 55 dB | +90 deg. | 60 dB | −90 deg. |
| Pair 36, 78 | 55 dB | +90 deg. | 60 dB | −90 deg. |
| Pair 12, 78 | 60 dB | +90 deg. | 60 dB | −90 deg. |

Also, in the exemplary embodiment shown in FIGS. 2-5, the PICs 100, with a plurality of compliant pins 102, that are formed with a bend having a rear portion 106 that contacts the printed circuit board 200 and a front portion 104 that is insertable in the PIC sled subassembly 10. However, the invention is not limited to this structure. For example, the PICs 100 can be of any possible shape which provides for electrical connection between the printed circuit board 200 and a male-type plug insertable into the female-type receptacle 8. The PICs 100 can also be structured to include resilient contact portions at their front portions, for example.

In an exemplary embodiment, the PICs 100 do not have to be disposed in slots defined in the PIC sled subassembly 10. Instead, the PICs 100 can be attached to the PIC sled subassembly 10 in accordance with any currently known or later developed method. In fact, the invention is intended to cover a modular jack assembly 2 that does not even include a PIC sled subassembly 10 and which utilizes another component, such as the housing 4, for example, to hold the PICs 100 in place.

The PICs 100 can also be formed in any shape and of any suitable currently known or later developed material or materials. For example, the PICs 100 can be formed of any electrically conductive, substantially electrically conductive, or semi-electrically conductive material, such as copper. Similarly, the PICs 100 can be manufactured by any currently known or later developed method.

Figure 6:
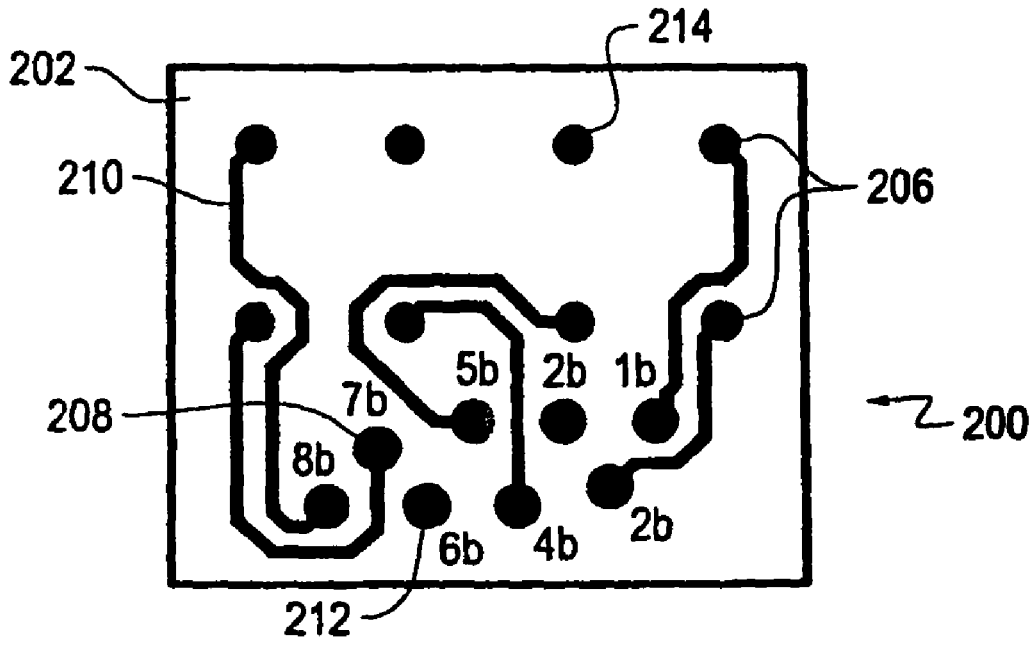
FIG. 6 is a schematic of a top layer of a printed circuit board according to an exemplary embodiment of the invention.
Figure 7:
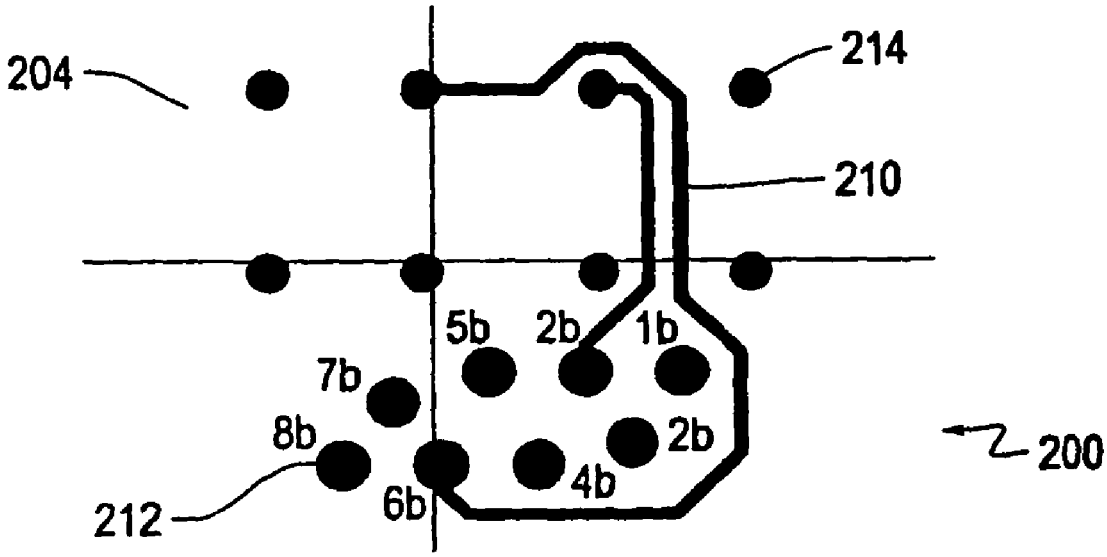
FIG. 7 is a schematic that shows the bottom layer of a printed circuit board according to an exemplary embodiment of the invention.

FIGS. 6 and 7 show a top layer 202 and a bottom layer 204 respectively, of a printed circuit board according to an exemplary embodiment of the invention.

As shown in FIGS. 6 and 7, the printed circuit board 200 mechanically and electrically mates the PICs and the IDCs by conductive traces 210. The printed circuit board 200 may also be used to strategically add additional capacitive coupling to enhance, increase or maximize the component and channel performance. In the exemplary embodiment of the invention, the printed circuit board 200 may have a plurality of inner layers disposed between the top layer 202 and the bottom layer 204. Integrated capacitors (not shown) may be disposed in the printed circuit board 200 to improve the performance of the modular jack assembly 2.

The physical design of the printed circuit board can be made to reduce or minimize the near end cross-talk (NEXT) and the far end cross-talk (FEXT) within the printed circuit board. The NEXT and/or FEXT are made up of capacitive imbalances and/or inductive imbalances.

As shown in the exemplary embodiment of FIGS. 6 and 7, the top layer 202 and bottom layer 204 of the printed circuit board 200 define a plurality of lower apertures 212 and a plurality of upper apertures 214. The compliant pins 102, numbered 1*a*-8*a*, of the PICs 100 extend at least partially inside of each of the respective lower apertures 212 to engage the printed circuit board 200. A conductive material at least in part surrounds the entrance end and exit end of each of the lower apertures 212 and coats the interior of each aperture, such that the PICs 100 contact the conductive material when the compliant pins 102 engage the lower apertures 212 of the printed circuit board 200.

As shown in the exemplary embodiment of FIGS. 6 and 7, the conductive material also at least in part surrounds the entrance end and exit end of each of the upper apertures 214 and coats the interior of each aperture, such that the IDCs 300 contact the conductive material when the compliant pins 302 engage the upper apertures 214 of the printed circuit board 200.

In the exemplary embodiment shown in FIGS. 6 and 7, the lower apertures 212 of the printed circuit board 200 are numbered 1*b*-8*b* to provide reference marks for proper insertion of the corresponding pins 102 into the printed circuit board 200, which as discussed below, correspond to respective twisted pairs of wires connectable to the jack assembly 2. Similarly, the upper apertures 214 may be numbered to provide reference locations for proper insertion of the compliant pins 302 of the IDCs 300.

As shown in FIGS. 6 and 7 respectively, the top layer 202 and the bottom layer 204 of the printed circuit board 200 show conductive traces 210 formed on the printed circuit board 200 to allow predetermined transmission pairs to electrically communicate. In an exemplary embodiment, the conductive traces 210 are formed so that the differential impedance is maintained at about 100 ohms. Further, in an exemplary embodiment the NEXT and/or FEXT between the pair combinations are reduced or minimized to control return loss and NEXT and/or FEXT.

The lower apertures 212 provide through-hole PIC pad locations 208. The upper apertures 214 provide through-hole IDC pad locations 206. The conductive traces 210 on the top layer 202 and on the bottom layer 204 may be etched, or otherwise formed, on the printed circuit board 200 to electrically connect the PIC pad locations 208 and the IDC pad locations 206.

As shown in the exemplary embodiment of FIGS. 6 and 7, the top layer 202 and bottom layer 204 of the printed circuit board 200 define a plurality of lower apertures 212 and a plurality of upper apertures 214. The compliant pins 102, numbered 1*a*-8*a*, of the PICs 100 extend at least partially inside of each of the respective lower apertures 212 to engage the printed circuit board 200.

As shown in FIGS. 6 and 7, the through-hole IDC pad locations 206 and through-hole PIC pad locations 208 define a plurality of apertures. The compliant pins 102 of the PICs 100 engage the printed circuit board 200 at the PIC pad through-hole locations 208 at their respective locations. Each of the compliant pins 102 extends at least partially inside of the PIC pad through-hole locations 208 so as to engage the printed circuit board 200. A conductive material forming the conductive traces 210 of the top layer 202 and the bottom layer 204 at least in part surround the entrance and an exit of each of the PIC pad through-hole locations 208 the interior of each PIC pad through location 208, such that the pins 102 contact the conductive material when engaged with the printed circuit board 200. Thus, the conductive material surrounding each of the PIC pad through-hole locations 208 provides for electrical communication between the pins 102.

In an exemplary embodiment, the cross-talk on the printed circuit board for six transmission pair combinations is less than about 55 decibels (dB) and the component performance is optimized with minimal additional capacitance.

In an exemplary embodiment of the invention, the combination of PIC NEXT/FEXT magnitude and phase and the printed circuit board capacitance may be optimized at 100 ohms. Table 3 provides the NEXT and FEXT vectors for these PICs in the exemplary embodiment.

TABLE 3

| | NEXT | | FEXT | |
|---|---|---|---|---|
| | Magnitude | Phase | Magnitude | Phase |
| Pair 45, 36 | 50 dB | +90 deg. | 49 dB | −90 deg. |
| Pair 45, 12 | 53 dB | +90 deg. | 59 dB | −90 deg. |
| Pair 45, 78 | 55 dB | +90 deg. | 70 dB | −90 deg. |
| Pair 36 12 | 54 dB | +90 deg. | 63 dB | −90 deg. |
| Pair 36, 78 | 56 dB | +90 deg. | 57 dB | −90 deg. |
| Pair 12, 78 | 76 dB | +90 deg. | 75 dB | −90 deg. |

Although Table 3 shows NEXT and FEXT vectors for PICs in an exemplary embodiment, additional embodiments may have differing vectors from those provided in Table 3.

The invention is not limited to the printed circuit board 200 discussed above and shown in the figures. In fact, the invention is intended to cover any printed circuit board structure. For example, in an exemplary embodiment of the invention, a six layered structure that includes conductive traces and inner layers may be used.

In an embodiment, the printed circuit board may include sixteen capacitors for cross-talk reduction, all in the inner layer. Further, the conductive traces for each pair of apertures corresponding to a twisted pair of wires can be provided to be as long as needed and be provided to extend near each other to obtain a proper or substantially proper impedance for return/loss performance.

In the printed circuit board 200, the capacitance provided by the capacitors can be added to the printed circuit board in order to compensate for, or substantially compensate for, the NEXT and/or FEXT which occurs between adjacent conductors of different pairs throughout the connector arrangement. However, the capacitance can be provided in accordance with any currently known or later developed technology. For example, the capacitance can be added as chips to the printed circuit board, or alternatively can be integrated into the printed circuit board using pads or finger capacitors.

However, as discussed above, any other printed circuit board structure can be used. For example, the invention is intended to cover a printed circuit board having a single layer or any number of layers. In fact, the modular jack assembly 2 in accordance with the invention does not even have to include a printed circuit board 200, and instead can utilize any currently known or later developed structure or method to electrically and mechanically connect the PICs 100 and the IDCs 300.

Figure 8:
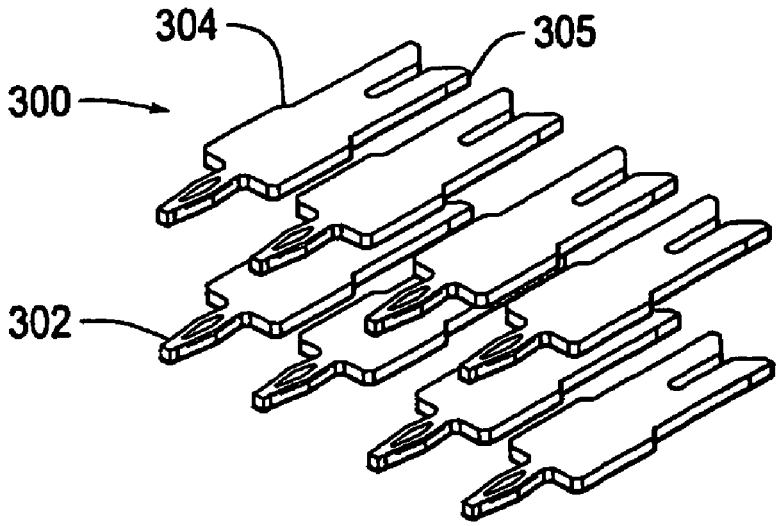
FIG. 8 is a perspective view of the insulation displacement contacts according to an exemplary embodiment of the invention.
Figure 9:
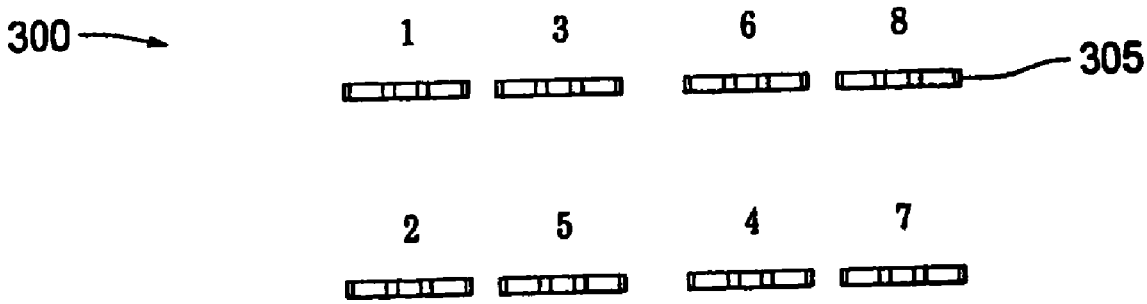
FIG. 9 is a back view of the insulation displacement contacts according to an exemplary embodiment of the invention.

FIG. 8 shows a three dimensional view of the insulation displacement contacts (IDCs), and FIG. 9 is a rear view of the IDCs, according to an exemplary embodiment of the invention.

In an exemplary embodiment of the IDCs, the transmission pairs are as short as allowable without introducing additional cross-talk. In the embodiment, NEXT and/or FEXT is less than about 55 decibels (dB) on one or more pair combinations.

The IDCs 300 mechanically and electrically mate the modular jack assembly 2 to electrical cable or transmission line conductors (not shown). The IDCs 300 are also configured in an orientation to reduce or minimize the cross-talk that may be induced by the IDCs 300.

The NEXT and/or FEXT include capacitive imbalances and/or inductive imbalances. The physical design and configuration of the IDCs 300 reduces or minimizes the NEXT and/or FEXT within the IDCs 300. For example, in an exemplary embodiment, the NEXT and/or FEXT of the IDCs for six transmission pair combinations is less than about 55 dB and the component performance is optimized, or substantially optimized, with reduced or minimal additional capacitance required on the printed circuit board 200.

The IDCs 300 can also be formed in any shape and of any suitable currently known or later developed material or materials. For example, the IDCs 300 can be formed of any electrically conductive, substantially electrically conductive, or semi-electrically conductive material, such as copper. Similarly, the IDCs 300 can be manufactured by any currently known or later developed method.

As shown in FIGS. 8 and 9, an exemplary embodiment of the modular jack assembly 2 includes a plurality of IDCs 300. In the exemplary embodiment, the IDCs 300 each include a compliant pin 302 at a front end and a rear sled engaging portion 304 at a rear end 305. As shown in FIG. 8, the rear end 305 may be bifurcated, for example, to displace the insulation on the conductor placed on the contact. When inserted into an upper aperture 214 of the printed circuit board 200, the pin 302 of each of the IDCs 300, extends at least partially within the IDC pad through-hole locations 206 in the printed circuit board 200. The engaging portion 304 of each IDC 300 engages with the rear sled 12 in a containment slot 14 (FIG. 10).

In the exemplary embodiment, the pins 302 of the IDCs 300 are arranged to engage the upper apertures 214 of the printed circuit board 200 at the IDC pad through-hole locations 206, at their respective locations. Each of the pins 302 extends at least partially inside of the IDC pad through-hole locations 206 so as to engage the printed circuit board 200. A conductive material forming the conductive traces 210 of the top layer 202 and the bottom layer 204, at least in part, surround the entrance and an exit end of each of the IDC pad through-hole locations 206. Thus, the conductive material surrounding each of the IDC pad through-hole locations 206 provides for electrical communication between the pins 302 and pins 102 by the conductive traces 210.

Figure 10:
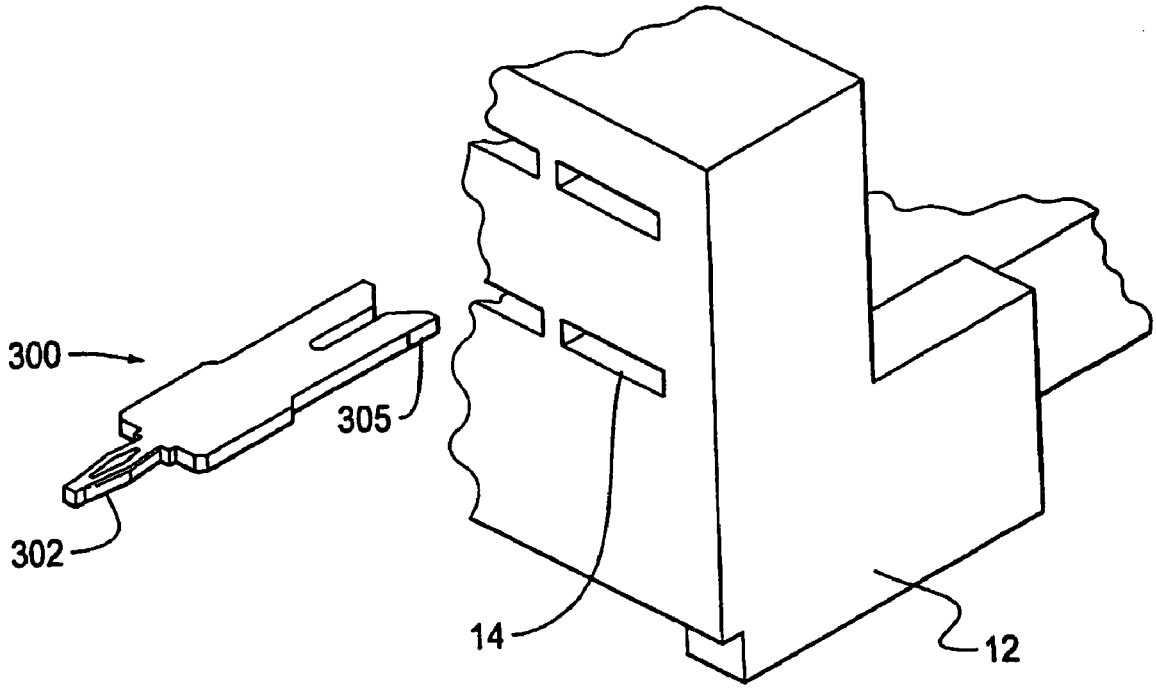
FIG. 10 is a perspective view of an insulation displacement contact according to an exemplary embodiment of this invention and a rear sled.

FIG. 10 is a perspective view of an IDC according to an exemplary embodiment of this invention and the rear sled 12.

In FIG. 10, the rear end 305 of an IDCs 300 is inserted into the rear sled 12 at a containment slot 14 of the rear sled 12. In one embodiment of the invention, the engaging portion 304 of the IDCs 300 may be widened to positively retain the IDC 300 in the containment slot 14.

Figure 11A:
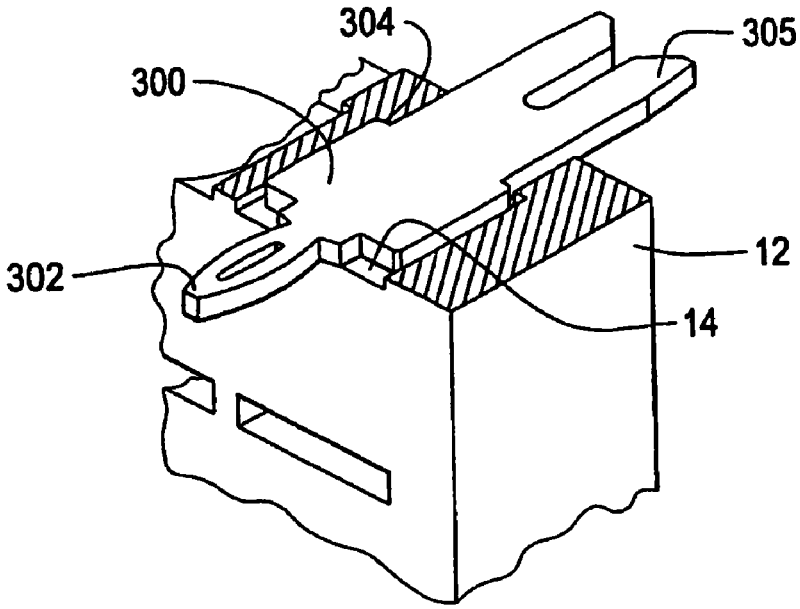
FIG. 11*a* is a sectional perspective view of the insulation displacement contacts inserted in a rear sled, according to an exemplary embodiment of the invention.
Figure 11B:
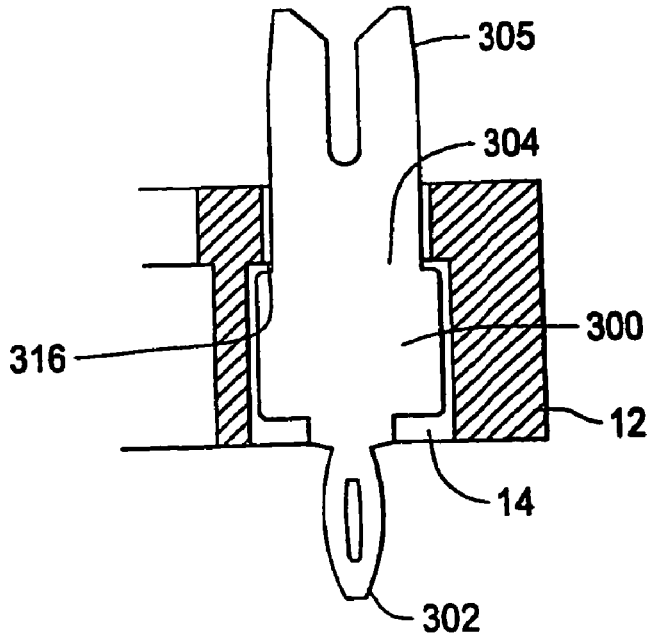
FIG. 11*b* is a sectional top view of the insulation displacement contacts inserted in a slot of a rear sled showing a narrowed portion of the slot, according to an exemplary embodiment of the invention.

FIG. 11*a* is a sectional perspective view of an IDC 300 inserted in the rear sled 12, according to an exemplary embodiment of the invention. FIG. 11*b* is a sectional top view of an IDC 300 inserted in a slot 14 of a rear sled 12 showing a narrowed portion of the slot 14, according to an exemplary embodiment of the invention.

As shown in FIGS. 11*a* and 11*b*, the slot 14 includes a narrowed portion 316 that engages rear sled engaging portion

304 and provides retention for holding the IDC 300 in the rear sled 12 and prevents the IDC 300 from being pulled out.

As shown in FIG. 1, an exemplary embodiment of the invention also includes a wire containment cap 18. The wire containment cap 18 is hollow and defines a channel that extends from its front end to its rear end. An electrical cable or transmission wire (not shown) that includes a jacket, which may be substantially round in cross-section, and which surrounds a plurality of twisted pairs of wires, such as four twisted pairs of wires, for example, extends into the wire containment cap 18 and contacts the rear end 305 of the IDCs 300 inserted in the rear sled 12 to allow the modular jack assembly 2 to communicate with a transmission wire.

In one exemplary embodiment of the invention, a signal from an electrical cable or transmission line that extends into the wire containment cap 18 is transmitted through the IDCs 300. A rear end 305 of the IDCs contact the electrical cable or transmission line and a front end 302 of the IDCs 300 is transmitted through the printed circuit board 200. The IDCs 300 provide an electrical and mechanically interface between the electrical cable or transmission line and printed circuit board 200. The PICs 100 also contact the printed circuit board 200 at the back end 106 of the PICs 100. The rear end of the PICs 100 contact a male-type plug when inserted into the female-type receptacle 8 of the housing 4. Thus, a signal traveling from an electrical cable or transmission line may communicate through the IDCs 300 to the printed circuit board 200 to the PICs 100 to a plug inserted into the modular jack assembly 2.

Although the above exemplary embodiment describes a signal traveling from an electrical cable or transmission line to a plug, the invention provides for bi-directional communication between a plug and an electrical cable or transmission line.

While the systems and methods of this invention have been described in conjunction with the specific embodiments outlined above, it is evident that many alternatives, modifications and variations will be apparent to those skilled in the art. Accordingly, the exemplary embodiments of the systems and methods of this invention, as set forth above, are intended to be illustrative, not limiting. Various changes may be made without departing from the spirit and scope of the invention.

What is claimed is:

1. A plug interface contact sub-assembly for use in an electrical connector comprising:

a plurality of compliant contacts, the plurality of contacts comprising a bend section, a contact section opposite the bend section, and an at least one compensation section disposed between the bend section and the contact section, wherein the at least one compensation section comprises three compensation layers;

a plurality of insulation displacement contacts; and a printed circuit board, the plurality of insulation displacement contacts and the plurality of compliant contacts being mounted on opposite sides of the printed circuit board, the printed circuit board further comprising a plurality of traces connecting the plurality of compliant pins to the plurality of insulation displacement contacts, the traces also comprising compensation circuitry.

2. The plug interface contact sub-assembly of claim 1 wherein the at least one compensation section comprises first, second, and third compensation sections.

3. The plug interface contact sub-assembly of claim 2 wherein a capacitive and an inductive coupling between an at least one pair of contacts of the plurality of contacts is different in the first compensation section than in the second compensation section.

4. The plug interface contact sub-assembly of claim 3 wherein a capacitive and an inductive coupling between an at least one pair of contacts of the plurality of contacts is different in the second compensation section than in the third compensation section.

5. The plug interface contact sub-assembly of claim 4 wherein the at least one pair of contacts are arranged in at least one of the first, second, and third compensation zones to reduce at least one of a capacitive and an inductive imbalance.

* * * * *